United States Patent [19]

Hamel

[11] 3,962,857

[45] June 15, 1976

[54] MACHINE FOR SIMULTANEOUSLY TWISTING A PLURALITY OF YARNS

[75] Inventor: Edmund Hamel, Romanshorn/TG, Switzerland

[73] Assignee: Evolution S.A., Rorschach, Switzerland

[22] Filed: Oct. 22, 1974

[21] Appl. No.: 517,015

[30] Foreign Application Priority Data

Oct. 24, 1973 Germany ..... 2353311

[52] U.S. Cl. ..... 57/59; 57/34 R; 57/104

[51] Int. Cl.[2] ..... D01H 7/10; D01H 7/08

[58] Field of Search ..... 57/104, 59, 106, 90, 57/34 R

[56] References Cited

UNITED STATES PATENTS

| | | | |
|---|---|---|---|
| 2,064,270 | 12/1936 | Rowe | 57/59 |
| 2,460,152 | 1/1949 | Sio | 57/104 |
| 2,946,178 | 7/1960 | Hamel | 57/104 X |
| 3,391,527 | 7/1968 | Kato | 57/104 X |
| 3,599,415 | 8/1971 | Jaeggli | 57/104 X |
| 3,645,084 | 2/1972 | Nimtz | 57/104 X |

*Primary Examiner*—Donald E. Watkins
*Attorney, Agent, or Firm*—Karl F. Ross; Herbert Dubno

[57] ABSTRACT

A horizontally elongated machine for twisting a plurality of different yarns has at least one longitudinally extending drive shaft. A plurality of horizontally extending and vertically spaced rows of twisters is provided on each side of the machine with each twister being rotatable about a respective axis perpendicular to the longitudinal direction of the machine. The twisters are driven in groups of two or four by a common flat belt spanned over the respective whorls of the twisters and over a single drive pulley on the drive shaft. A takeup device for each of the twisters is provided directly above the twister.

17 Claims, 8 Drawing Figures

MACHINE FOR SIMULTANEOUSLY TWISTING A PLURALITY OF YARNS

CROSS-REFERENCE TO RELATED APPLICATION

This application is related to my copending and commonly assigned patent application Ser. No. 444,714 filed Feb. 22, 1974 for a METHOD OF AND APPARATUS FOR TWISTING YARN (now U.S. Pat. No. 3,869,852).

FIELD OF THE INVENTION

The present invention relates to a yarn-twisting machine. More particularly this invention concerns an apparatus for simultaneously spinning a plurality of separate yarns.

BACKGROUND OF THE INVENTION

My above-cited copending patent application describes a system wherein a yarn package is carried on a spindle rotated at high speed about its longitudinal axis. A tube concentric with the axis has an open end and forms a cup completely spacedly surrounding the yarn package with its rim lying axially beyond the end of the yarn package. A takeup eye or guide is provided adjacent this end of the assembly but is spaced from the end of the tube, and generally centered on the rotation axis of the tube and the yarn package. Thus the yarn is pulled off the yarn package to form a balloon which extends axially beyond the end of the bobin up to the takeup eye. In this manner there is formed within the tube a body of air which rotates with the yarn package, and above the tube between it and the takeup guide there is formed a vortex having rotation speed which decreases away from the yarn package. Pulling the yarn through this vortex breakes it effectively and therefore tensions the yarn to an extent which is determined by the distance between the guide and the upper rim of the tube, this business determining the position of the yarn in the vortex. The yarn package lies below the rim of the tube or shell so that initially the yarn is drawn off through a body of air rotating the bobin and the shell, and is thereafter drawn through an air vortex with axially decreasing air velocity.

Such twisting devices are usually arranged upright, rotatable about vertical axes and in groups on a common horizontally elongated frame. In order to allow servicing of each of these twisting arrangements they are arranged in a straight line spaced apart by a distance sufficient to allow the operators to load new yarn packages into them and remove the old core.

OBJECTS OF THE INVENTION

It is an object of the present invention to provide an improved apparatus for twisting a plurality of yarns or filaments.

Yet another object is the provision of such an apparatus which occupies a relatively reduced floor space but which is capable of twisting a great number of such filaments simultaneously.

Yet another object is the provision of such an apparatus having a simplified drive means for a number of such spinning devices.

SUMMARY OF THE INVENTION

These objects are attained according to the present invention in an apparatus wherein a plurality of such spinning devices are rotated about respective horizontal axes extending transverse to the longitudinal direction of the spinning machine. Such an arrangement allows a plurality of vertically spaced horizontal rows of such spinning devices to be mounted on the same machine. It is also possible to provide a plurality of such vertically spaced rows on both sides of the machine so as greatly to increase the capacity of a single filament-twisting apparatus. The array on each side of the machine can comprise a plurality of horizontal and vertical rows of separate yarn twisters. When four vertically spaced rows are employed, the lower two rows in accordance with this invention are staggered relative to the upper two rows so as to maximize sufficient use of space.

According to yet another feature of the invention the machine is provided with a horizontal drive shaft passing longitudinally between a pair of vertically spaced and horizontally extending rows of twisters. A plurality of drive belts each connect a respective drive pulley on this drive shaft with at least one twister above the shaft and at least one twister below the shaft. It is possible in accordance with the present invention to use a single such drive belt to drive four twisters simultaneously.

In accordance with yet another feature of this invention the machine is provided for each twister with a takeup device. These takeup devices are also arranged in horizontal rows lying between the rows of twisters.

Thus in accordance with the present invention an extremely compact machine is provided which is capable of simultaneously twisting a great number of filaments.

BRIEF DESCRIPTION OF THE DRAWING

The above and other objects, features, and advantages will become more readily apparent from the following, reference being made to the accompanying drawing in which.

SPECIFIC DESCRIPTION

Figure 2:
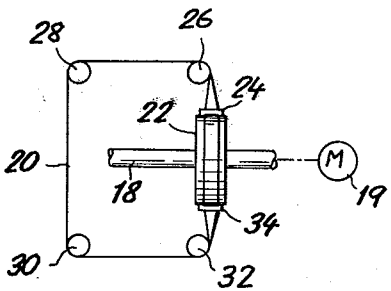
FIG. 2 is a view taken in the direction of arrow II of FIG. 1.

A twisting machine according to the present invention has a longitudinally and horizontally elongated frame 10 provided with a pair of parallel and horizontal longitudinally extending channel beams 14 each carrying a plurality of horizontal and parallel shafts 12 extending at right angles to the machine frame 10 and forming two rows R1 and R2 of twisters, four of which are shown in FIG. 2 at 26, 28, 30, and 32. Extending longitudinally and horizontally the length of the machine between the rows R1 and R2 is a drive shaft 18 continuously rotated by a motor 19 and carrying a pulley 22 over which is reeved a flat drive belt 20 which passes over a pair of deflecting rollers 24 and 34 and then over whorls on the shaft 12. This serves to rotate the four twisters 26, 28, 30, and 32 all in the same direction. Each of these twisters comprises an outer tube 42, an inner tube 41, and a yarn package 39 from which a filament 43 is drawn which passes over a respective deflecting pin and then is wound up by a takeup device 36 comprising a takeup spool 40 and a drive roller 38. The drive rollers 38 are operated at a constant speed so as to determine the peripheral speed of the spool 40 and therefore the takeup speed of the respective yarn 43 as it is twisted. The takeup devices 36 are each located above the respective twister, and those takeup devices 36 for the lower row R1 are situated between the rows R1 and R2.

Figure 3:
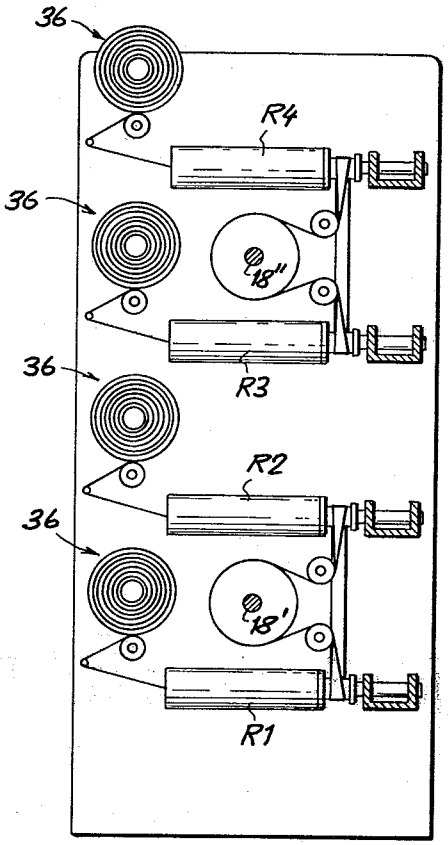
FIGS. 3 and 4 are cross sections through further arrangements in accordance with the present invention.
Figure 1:
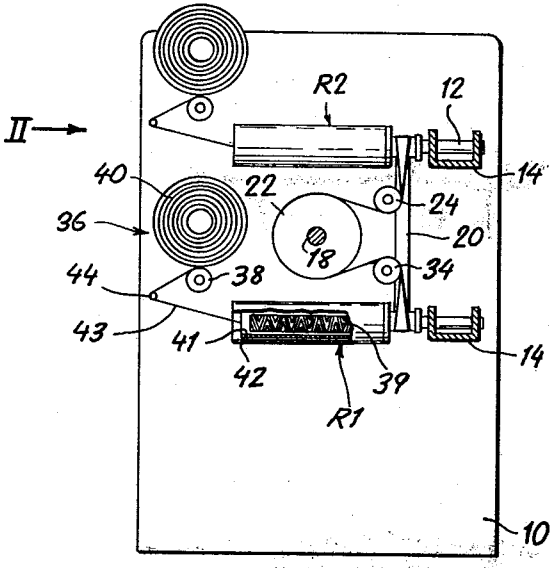
FIG. 1 is a vertical section through an apparatus according to the present invention.

The apparatus shown in FIG. 3 is identical to that shown in FIG. 1 except that here four rows R1– R4 are employed which are driven by two separate drive shafts 18' and 18''. In other respects this arrangement is identical to that of FIG. 1.

Figure 5:
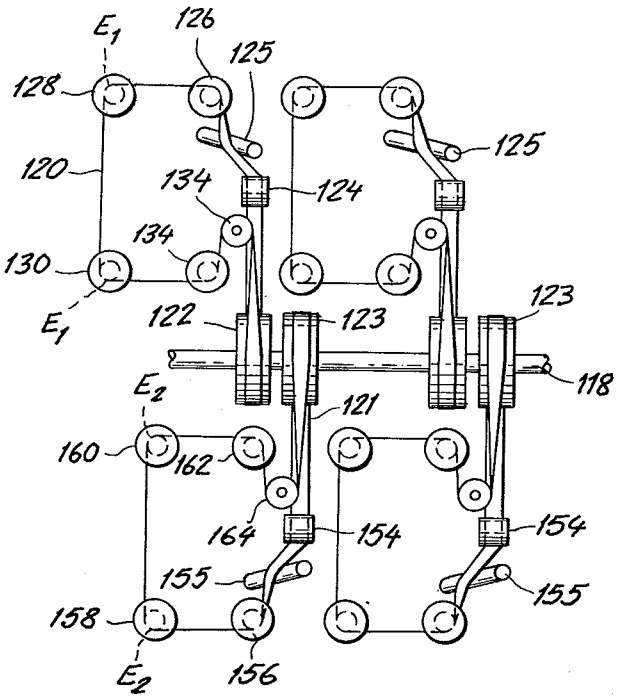
FIG. 5 is a view taken in the direction of arrow V of FIG. 4.
Figure 4:
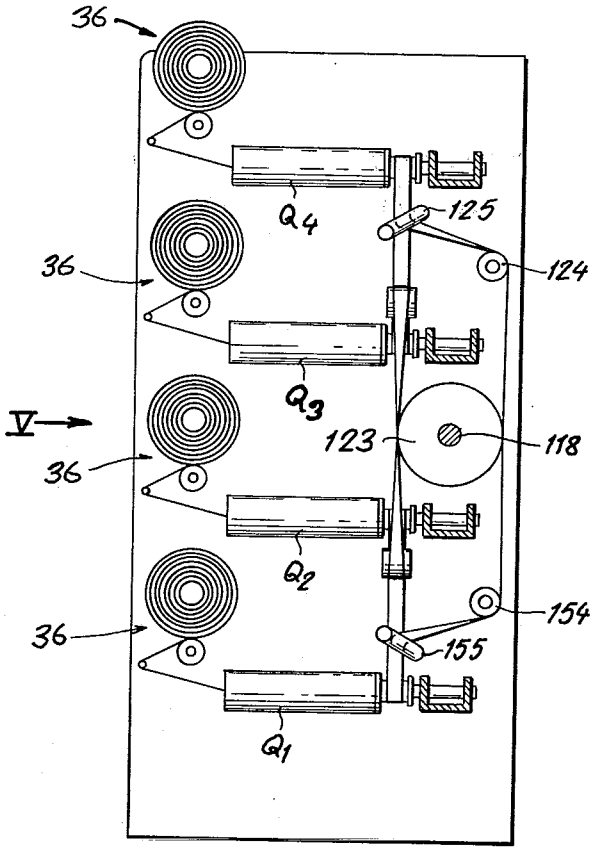

The twisting machine of FIG. 4 shows four rows $Q_1$ to $Q_4$ of twisters. As further indicated by FIG. 5 these four rows are all driven by a common horizontal longitudinally extending drive shaft 118 situated between the rows $Q_2$ and $Q_3$. This shaft 118 carries a pair of drive pulleys 122 and 123. A flat belt 120 runs over the pulley 122, over deflecting rollers 124 and 125, whorls 126, 128, 130, and 132, and over another deflecting roller 134 back to the drive pulley 122. Another belt 121 runs over the drive pulley 123, over deflecting rollers 154 and 155, over whorls 156, 158, 160 and 162, and over another deflecting roller 164 back to the drive pulley 123. FIG. 5 also clearly indicates how the twisters in the lower two rows $Q_1$ and $Q_2$ are staggered relative to the twisters in the upper two rows $Q_3$ and $Q_4$, with the whorls 128, and 130, for example, of the upper rows $Q_3$ and $Q_4$ lying in a plane $E_1$ and the whorls 158 and 160, for example, of the lower rows $Q_1$ and $Q_2$ lying in a plane $E_2$ offset longitudinally from the plane $E_1$.

Figure 6:
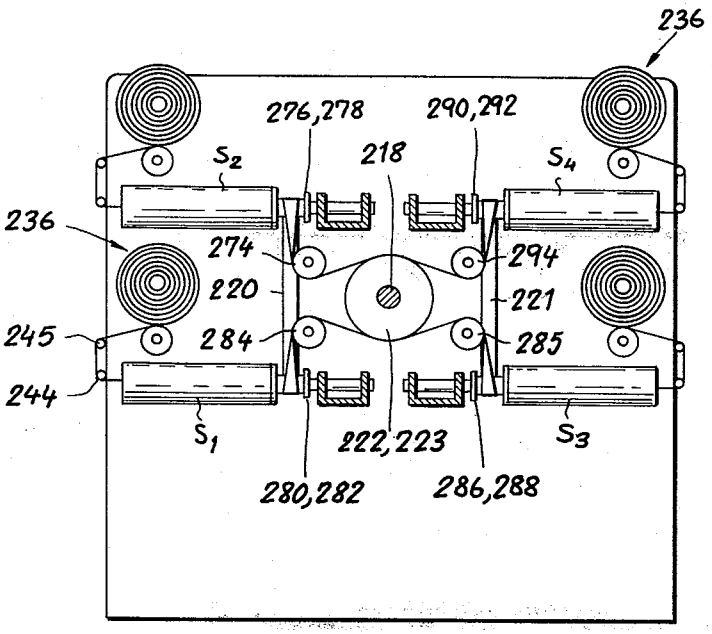
FIG. 6 is a cross section through yet another apparatus in accordance with the present invention.
Figure 7:
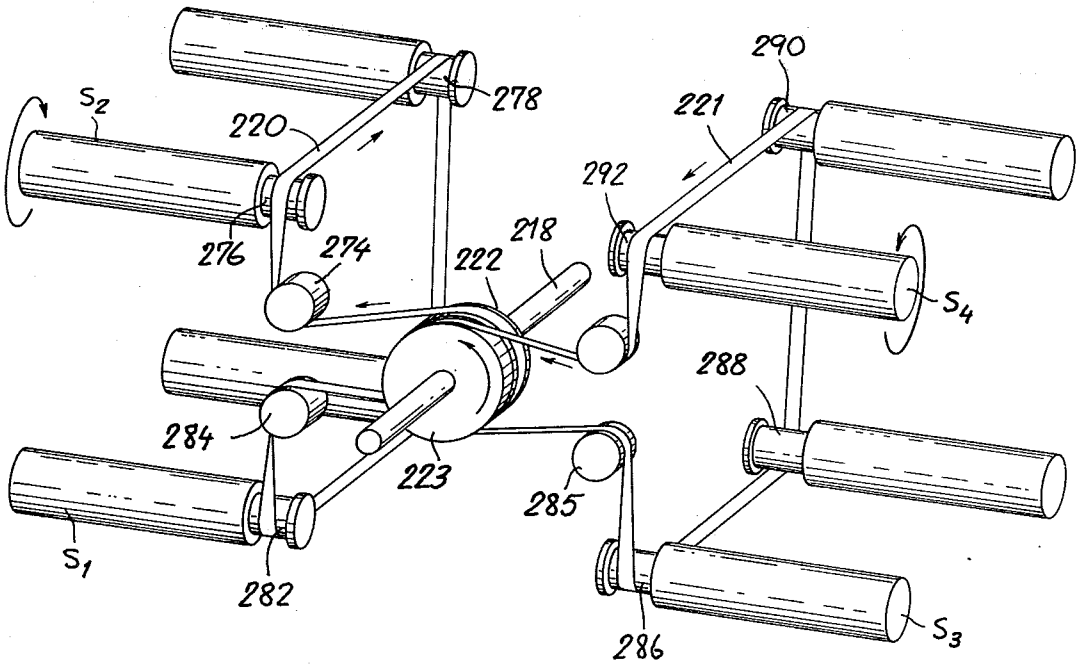
FIG. 7 is a perspective view of the drive arrangement of the apparatus of FIG. 6, with parts removed for clarity.

FIGS. 5 and 6 show an arrangement with rows $S_1$ and $S_2$ on one side of the apparatus and rows $S_3$ and $S_4$ on the other side. Belts 220 and 221 run over respective drive pulleys 222 and 223 which are both mounted on a single longitudinally extending drive shaft 218. The shaft 218 is in the center of the apparatus in effect lying in a vertical symmetry plane of the machine. Belt 220 runs from the drive pulley 222 over a deflecting roller 274, whorls 276 and 278, whorls 280 and 282, and another deflecting wheel 284 back to the pulley 222. The belt 221 runs correspondingly over a deflecting roller 285, whorls 286, 288, 290, and 292, and again over a deflecting rolle 294 back to the drive pulley 223. A further feature of this arrangement is that directly above each of the twisters there is provided a respective takeup 236 with the filament passing over a pair of guide rollers 244 and 245.

Figure 8:
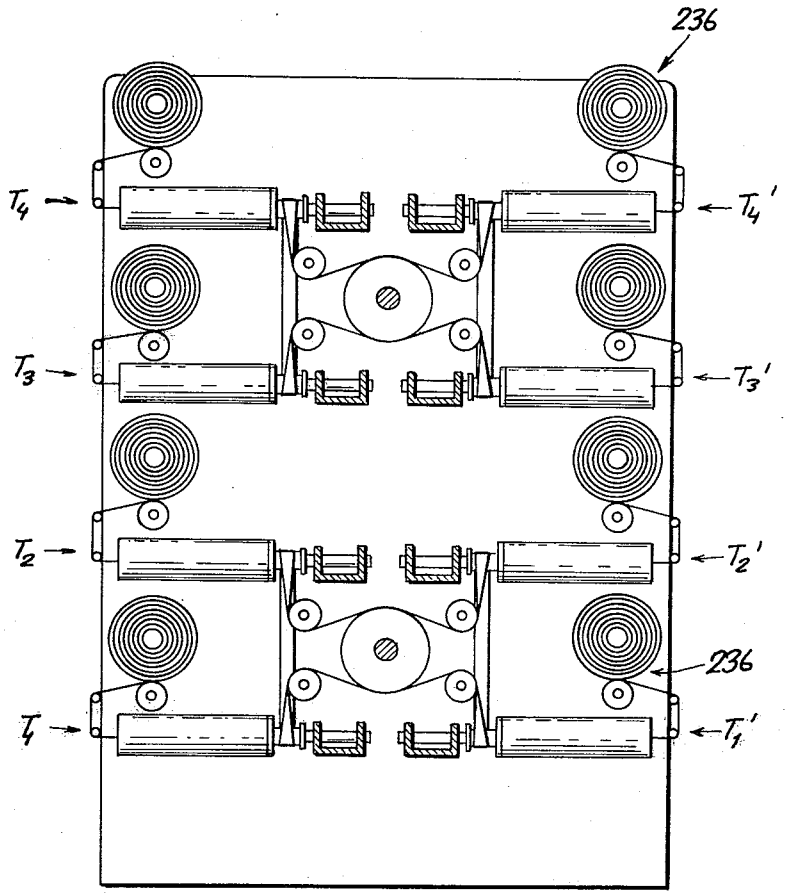
FIG. 8 is a cross section through yet another apparatus in accordance with the present invention.

The arrangement of FIG. 8 is identical to that of FIG. 6 except that here four rows $T_1 - T_4$ on one side of the machine and four rows $T_1'$ $T_4'$ on the other side of the machine allow the floor space that would be used with a prior art device for only one twister to here be employed for eight separate twisters. It is also possible to have more than four rows, such as in a system with six or eight rows on each side. Such a system may also be combined with a prior-art type system with twisters on the top of the machine as well as along both of the sides.

I claim:

1. An apparatus for twisting a plurality of yarns, said apparatus comprising:

a horizontally elongated support;

a plurality of twisters on said support each having a respective yarn package and a respective rotatable sleeve surrounding said package, said twisters each being rotatable about a respective horizontal axis transverse to said support;

takeup means for drawing respective yarns from said packages of said twisters; and drive means extending longitudinally through said support for rotating said twisters about their respective axes.

2. The apparatus defined in claim 1 wherein said twisters are arrayed in a plurality of vertically spaced and horizontally extending rows.

3. The apparatus defined in claim 2 wherein two such rows are provided with the axes of the twisters in the upper row lying directly above the axes of the twisters in the lower row.

4. The apparatus defined in claim 3 wherein said drive means includes a horizontal drive shaft extending logitudinally through said support and a plurality of drive belts each spanned over said shaft and operatively engaging at least two respective twisters.

5. The apparatus defined in claim 4 wherein said twisters are each provided with a whorl and said drive shaft is provided with a drive pulley for each of said belts, each belt being spanned over a respective drive pulley and over the whorls of two adjacent twisters in said upper row and over the whorls of the two twisters in said lower row lying directly underneath.

6. The apparatus defined in claim 5 further comprising at least two deflecting rollers spaced vertically above and below said drive shaft for each belt.

7. The apparatus defined in claim 2 wherein said takeup means includes a plurality of driven takeup spools each adjacent a respective twister.

8. The apparatus defined in claim 7 wherein each takeup spool is mounted on said support immediately above the respective twister.

9. An apparatus for twisting a plurality of yarns, said apparatus comprising:

a horizontally elongated support;

a plurality of twisters on said support each having a respective yarn package and a respective rotatable sleeve surrounding said package, said twisters each being rotatable about a respective horizontal axis transverse to said support, said twisters being arranged in a plurality of vertically spaced horizontally extending rows; the axes of the twisters in an upper row lie directly above the axes of the twisters a lower row, four such rows are provided with the axes of the twisters in the upper two rows being vertically aligned and the axes of the twisters in the lower two rows being vertically aligned and horizontally offset from the axes of the twisters in the upper two rows;

takeup means for drawing respective yarns from said packages of said twisters; and drive means extending longitudinally through said support for rotating said twisters about their respective axes.

10. The apparatus defined in claim 9 wherein said drive means includes a horizontal shaft extending longitudinally through said support and a plurality of drive belts each spanning over said shaft and operatively engaging at least two respective twisters.

11. The apparatus defined in claim 10, said twisters being each provided with a whorl and said drive shaft is provided with a drive pulley for each of said belts, each belt being spanned over a respective drive pulley and over the whorls of two adjacent twisters in said upper row and over the whorls of the two twistrs in said lower row lying directly underneath.

12. The apparatus defined in claim 9 wherein said takeup means includes a plurality of driven takeup spools each adjacent a respective twister.

13. The apparatus defined in claim 12 wherein each takeup spool is mounted on said support immediately above the respective twister.

14. An apparatus for twisting a plurality of yarns, said apparatus comprising:

a horizontally elongated support;

a plurality of twisters on said support each having a respective yarn package and a respective rotatable sleeve surrounding said package, said twisters each being rotatable about a respective horizontal axis transverse to said support, said twisters being arranged in a plurality of vertically spaced horizontally extending rows, the axes of the twisters in an upper row lie directly above the axes of the twisters in a lower row;

takeup means for drawing respective yarns from said packages of said twisters; and drive means extending longitudinally through said support for rotating said twisters about their respective axes, said drive means including a horizontal drive shaft extending longitudinally through said support and a plurality of drive belts each spanned over said shaft and operatively engaging at least two respective twisters, said twisters being each provided with a whorl and said drive shaft is provided with a drive pulley for each of said belts, each belt being spanned over a respective drive pulley and over the whorls of two adjacent twisters in said upper row and over the whorls of the two twisters in said lower row lying directly underneath, at least two deflecting rollers beng spaced vertically above and below said drive shaft for each belt, said machine having a pair of longitudinal sides each provided with at least two such rows of such twisters all driven by said drive shaft.

15. The apparatus defined in claim 14 wherein four such rows are provided with the axes of the twisters in the upper two rows being vertically aligned and the axes of the twisters in the lower two rows being vertically aligned and horizontally offset from the axes of the twisters in the upper two rows.

16. The apparatus defined in claim 14 wherein said takeup means includes a plurality of driven takeup spools each adjacent a respective twister.

17. The apparatus defined in claim 16 wherein each takeup spool is mounted on said support immediately above the respective twister.

* * * * *